US005947128A

United States Patent [19]

Adedeji

[11] Patent Number: 5,947,128

[45] Date of Patent: Sep. 7, 1999

[54] METHOD FOR MAKING A RECONSTITUTED TOBACCO SHEET USING STEAM EXPLODED TOBACCO

[75] Inventor: Jide Adedeji, Macon, Ga.

[73] Assignee: Brown & Williamson Tobacco Corporation, Louisville, Ky.

[21] Appl. No.: 08/986,862

[22] Filed: Dec. 8, 1997

[51] Int. Cl.[6] ..... A24B 3/14; A24B 15/12

[52] U.S. Cl. ..... 131/374; 131/297; 131/298; 131/305; 131/311; 131/353; 131/356; 131/357; 131/370; 131/372

[58] Field of Search ..... 131/297, 298, 131/305, 311, 353, 356, 357, 370, 372, 374

[56] References Cited

U.S. PATENT DOCUMENTS

| | | | |
|---|---|---|---|
| 3,077,890 | 2/1963 | Doyle et al. | 131/374 |
| 3,223,090 | 12/1965 | Strubel et al. . | |
| 3,398,754 | 8/1968 | Tughan | 131/374 |
| 3,575,178 | 4/1971 | Stewart | 131/140 |
| 3,753,440 | 8/1973 | Ashburn | 131/140 |
| 4,094,323 | 6/1978 | Frazier et al. . | |
| 4,148,325 | 4/1979 | Solomon et al. . | |
| 4,211,243 | 7/1980 | Ohno et al. | 131/140 |
| 4,235,249 | 11/1980 | Psaras et al. . | |
| 4,244,381 | 1/1981 | Lendvay . | |
| 4,270,552 | 6/1981 | Jenkins et al. . | |
| 4,582,070 | 4/1986 | Jewell . | |
| 4,730,627 | 3/1988 | Burcham, Jr. et al. . | |
| 4,766,912 | 8/1988 | Hackman et al. | 131/296 |
| 5,095,922 | 3/1992 | Johnson et al. . | |
| 5,143,097 | 9/1992 | Stephen Sohn et al. | 131/372 |
| 5,325,877 | 7/1994 | Young et al. | 131/370 |
| 5,377,698 | 1/1995 | Litzinger et al. . | |
| 5,765,570 | 6/1998 | Litzinger et al. | 131/370 |

FOREIGN PATENT DOCUMENTS

| | | | |
|---|---|---|---|
| 434333 | 6/1991 | European Pat. Off. | 131/356 |

OTHER PUBLICATIONS

Lewis, Richard; Hawley's Condensed Chemical Dictionary, p. 68, 1993.

*Primary Examiner*—James Derrington
*Assistant Examiner*—Michael P. Colaianni
*Attorney, Agent, or Firm*—Middleton & Reutlinger; Charles G. Lamb

[57] ABSTRACT

A process to improve the smoke quality and mechanical properties of reconstituted tobacco is accomplished by adding tobacco materials to an aqueous solution containing ammonium salts and urea. The resulting first tobacco slurry is then pressurized under steam pressure to at least 60 psi for a period of from 1 to 5 minutes then depressurized rapidly to ambient. The depressurized tobacco is then formed into a second tobacco slurry wherein the soluble components within the tobacco is removed. The resulting tobacco residue is then prepared into a reconstituted tobacco sheet and the extract is then concentrated to a solids level of at least 30 percent by weight of solids which is added back to the reconstituted tobacco sheet for further processing into smoking articles.

27 Claims, 2 Drawing Sheets

METHOD FOR MAKING A RECONSTITUTED TOBACCO SHEET USING STEAM EXPLODED TOBACCO

BACKGROUND OF THE INVENTION

This invention relates to a high temperature and pressure treating process for tobacco and more particularly to a process to improve the smoking quality and mechanical properties of a reconstituted tobacco sheet by steam exploded tobacco.

In the manufacture of smoking articles, such as cigarettes, pipe tobacco and the like, a substantial portion of the tobacco which has been processed for use in the smoking articles are found to be unsuitable for use because of their physical size or undesirable taste properties. For example, tobacco stems and tobacco fines from manufacturing processes are unsuitable for use in the manufacturing of these smoking articles. Since the stems and fines represent a substantial amount of raw material investment, processes have been developed to further process these stems and fines into products such as reconstituted tobacco sheets which are then useable in relatively large amounts in a mixture with acceptable processed tobacco leaf. In the processing of reconstituted tobacco some of the components within the stems and fines are solubilized and separated from the tobacco solids. These solubilized components are either discarded or a portion thereof is re-introduced at a later stage into the processing of reconstituted tobacco sheets. For example, U.S. Pat. No. 4,744,375 to Denier et al teaches a process for using flavor compounds in tobacco, such as ammonia, to produce a tobacco product which may be utilized in reconstituted tobacco sheets.

SUMMARY OF THE INVENTION

The present invention relates to a method for providing a reconstituted tobacco material wherein the tobacco in the form of stems and fines are dispersed in water. The resulting tobacco slurry is heated within a closed vessel under pressure with saturated steam and maintained for sufficient time to allow swelling or explosion of the tobacco. The vessel is then rapidly depressurized to ambient which results in fiberization of the tobacco particles and chemical depolymerization of some of the constituents within the tobacco. This mechanical action also causes a release and solubilization of pectins, and a slight structural and morphological transformation of the tobacco components. The resulting tobacco product may then be extracted in water and the fibrous material formed into a sheet using known paper making equipment. The aqueous extract is generally concentrated and applied to the formed sheet and further processing results in a reconstituted tobacco product having reduced irritation, better tobacco taste and improved smoke quality. Urea and an ammonium salt are added to the tobacco slurry either before or after pressurization with steam with the urea and ammonium salt being added preferably before the steam pressurization. Inverted sugars and humectants have also been found useful in the present invention as well as other selected chemical additives.

It is therefore an object of the present invention to provide a tobacco product for use in reconstituted tobacco resulting in reduced irritation, better tobacco taste, and improved smoke quality.

More particularly, the present invention is directed to a method for making reconstituted tobacco sheets comprising the steps of: adding from 50 to 100 parts by weight of tobacco materials to a vessel containing from 100 to 200 parts by weight of water, from 1 to 10 parts by weight of an ammonium salt, and from about 1 to 10 parts by weight of urea; bringing the resulting first tobacco slurry mixture to about 200 to 420° F. and 60 to 400 psi with saturated steam for a period of from about 1 to 15 minutes; and, reducing the pressure on the first tobacco slurry mixture to ambient in from 0.1 to 1.0 minutes. Preferably, the ammonium salt will be from 5 to 10 parts by weight, the urea will be from 3 to 8 parts by weight, and the total chemical additives to the tobacco/water mix will be from 10 to 25 parts by weight.

In the processing of the first slurry to a sheet of tobacco the process generally includes the additional steps of: adding water to form a second tobacco slurry having from 15 to 40 percent by weight of tobacco; heating the second resulting tobacco slurry mixture to from 120 to 180° F. for about 2 to 5 minutes; removing water and solubles from the second tobacco slurry to form a third tobacco slurry containing from about 50 to 60 percent by weight of water and an extract; reducing the particle size of the tobacco; adding water to form a fourth tobacco slurry having from about 1 to 4 percent by weight of tobacco; and, forming a sheet of tobacco having from about 10 to 30 percent by weight of moisture, preferably about 13 to 16 percent by weight of moisture. In the processing of the extract, the extract is generally concentrated to about 30 to 35 percent by weight of solubles and the resulting extract is then used to coat the formed sheet of tobacco.

Preferably, in the present invention the ammonium salt will be selected from the group consisting of diammonium phosphate, ammonium acetate, ammonium chloride, ammonium phosphate and mixtures thereof. Humectants, such as glycerine and propylene glycol, as well as inverted sugars, such as glucose and fructose may also be used. The preferred temperature to which the first tobacco slurry will be heated will be approximately 335° F. with approximately 100 psi of saturated steam wherein the tobacco will be subjected to the steam pressure and temperature for a time of approximately 3 minutes.

In an alternative embodiment, the chemical additives are added to the first tobacco slurry after the first tobacco slurry has been subjected to saturated steam at from about 200 to 420° F. and 60 to 400 psi for a period of from about 1 to 15 minutes and then reduced in pressure to ambient prior to further processing into a sheet of tobacco.

A better understanding of the present invention will be realized from the hereafter processes and the Examples following such description.

DETAILED DESCRIPTION OF THE PREFERRED EMBODIMENTS

Figure 2:
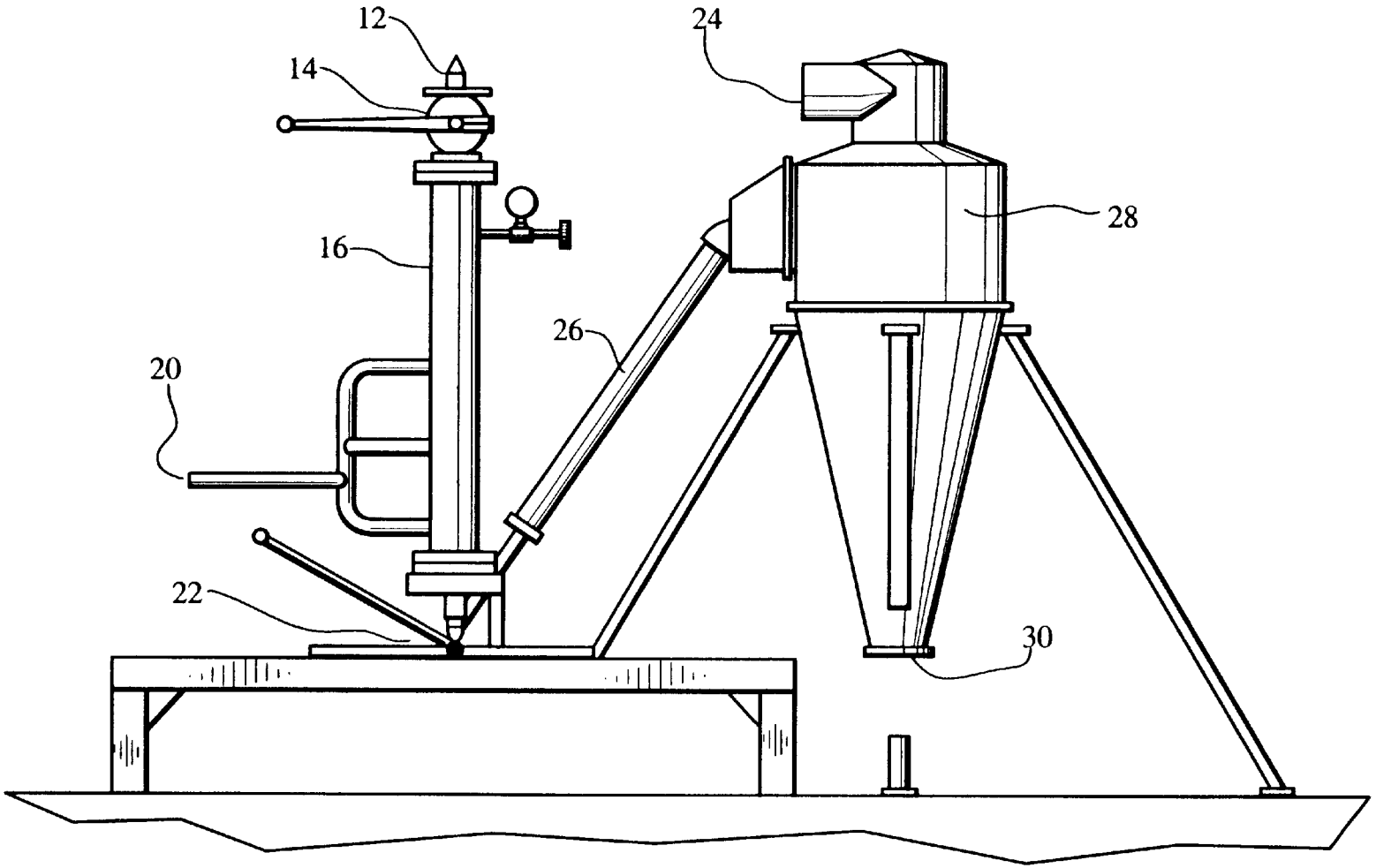

In a preferred method of carrying out the steam explosion portion of the present invention, as shown in FIG. 2, tobacco materials in the form of flue cured scraps, burley scraps, threshing and fabrication dust, shredded tobacco meal, flue cured stems, burley stems, and the like, are fed into the inlet 12 of a pressure vessel 16 containing water, an ammonium salt, and urea. A humectant and an inverted sugar may also be added. The total amount of tobacco is in the range of from about 50 to 100 parts by weight to about 100 to 200 parts by weight of water, from about 1 to 10 parts by weight of ammonium salt, from about 1 to 10 parts by weight of urea, less than 1 part by weight of humectant and less than 1 part by weight of inverted sugar. A valve 14 is provided at the inlet 12 to close off the vessel 16 after loading and before steam pressurization.

The ammonium salts which have been found useful in the present invention include diammonium phosphate, ammonium acetate, ammonium chloride, ammonium phosphate, and the like, and mixtures thereof. Preferably, the ammonium salts are from 1 to 5 parts by weight.

Other additives which have been found useful in the present invention include potassium sorbate, citrus pectin, as well as citric and lactic acids. Usually these additives are from 1 to 10 parts by weight and preferably less than 5 parts by weight.

The resulting water/tobacco mix or first tobacco slurry is then subjected to steam through steam inlet 20 wherein steam at from about 60 to 400 psi is introduced until the temperature of the tobacco slurry is increased to from about 60 to 400° F. The resulting temperature is then held for about 1 to 15 minutes. Preferably, the steam will be at approximately 100 psi and about 335° F. with a hold time of about 3 minutes.

The steam pressurized tobacco is then depressurized rapidly in from about 0.1 to 1.0 minutes to ambient. Release valve 22 is then opened and the first tobacco slurry is then transferred by way of conduit 26 into a cyclone separator 28 where steam is exhausted out through outlet 24 and the resulting product is discharged from the bottom discharge 30 for further processing.

Figure 1:
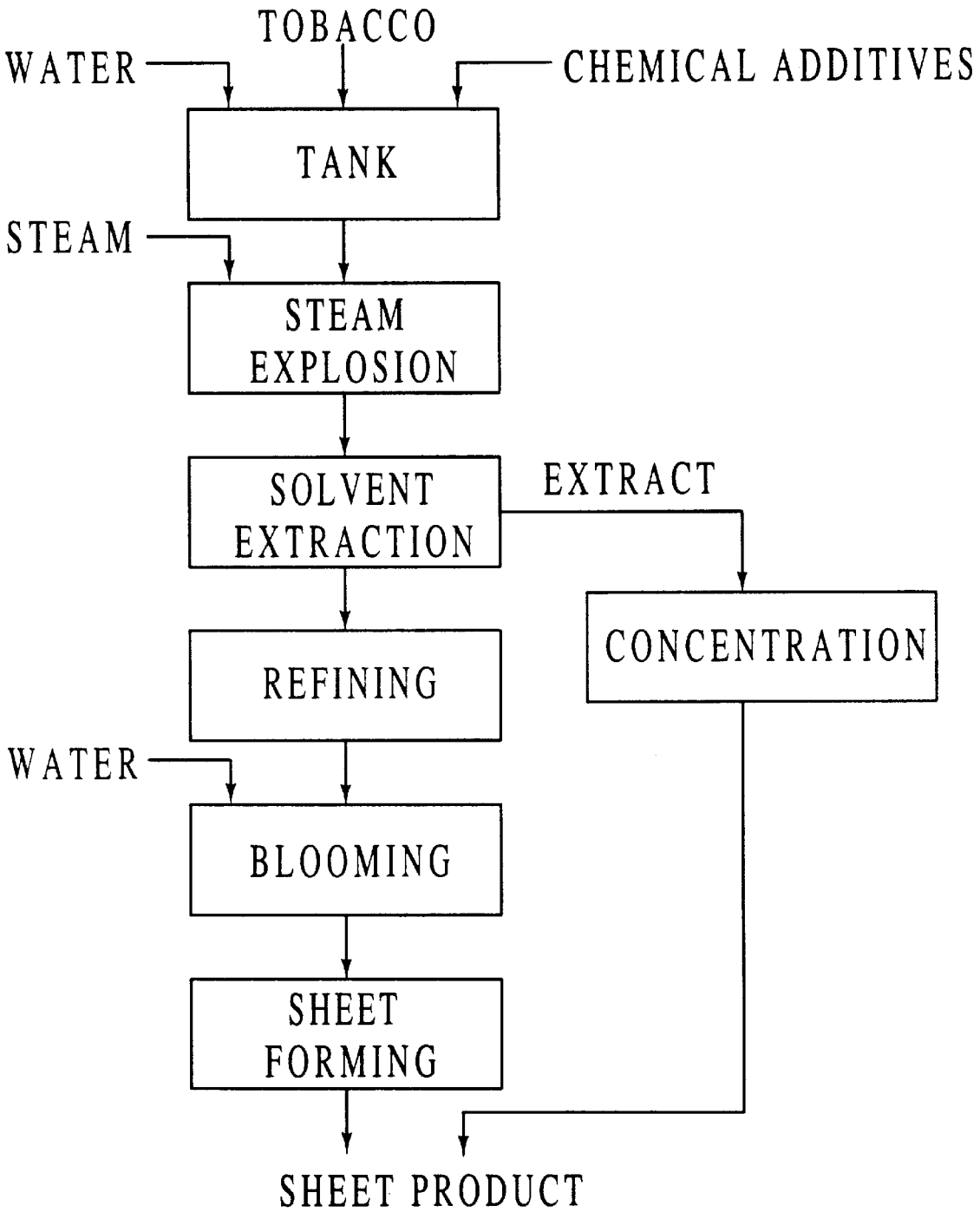
FIG. 1 is a schematic of one preferred process of the present invention; and, FIG. 2 is an elevational view of one preferred system for steam explosion of tobacco of the present invention.

As shown in FIG. 1, slurry from the steam explosion portion in the process which includes the cyclone separator 28 is transferred to a slurry tank where water is added to produce a second tobacco slurry having from about 1 to 4 percent by weight of solids. In an alternative embodiment, the urea, ammonium salt, and other chemicals may be added into the second tobacco slurry. The second resulting tobacco slurry is then heated to from about 120 to 180° F. and held at this temperature for about 2 to 5 minutes to extract the water soluble components from the tobacco which has been expanded by the steam pressurization. This mixture is then centrifuged with the extracted residue which is generally from about 40 to 50 percent by weight of tobacco being further refined by reduction of the particle size of the tobacco fibers. This is generally accomplished in a blender or other type of equipment equipped to agitate or pulverize to tobacco. The re-fined slurry is then transported to a blooming operation where the tobacco slurry is mixed with water wherein the solids are reduced to 1 to 4 percent by weight of the mixture. The mixture is then formed into reconstituted tobacco sheets using commercially available paper making equipment and techniques, such as, for example, a Fourdiner type machine. The extract from the centrifuge is transferred to an evaporator, such as a vapor vacuum evaporator, wherein the solid contents of the extract is increased to from about 30 to 35 percent by weight solids and then it is applied through known coating techniques to the resulting tobacco sheet. The resulting sheet is then prepared for further processing into smoking quality tobacco.

EXAMPLES 1–9

For a better understanding of the present invention, the following Examples are incorporated herein to illustrate the present invention with no intention of being unduly limited thereby.

EXAMPLE 1

A 10 pound mixture of tobacco materials including tobacco scraps, threshing and fabrication dust, tobacco meal, flue cured stems, and burley stems were dispersed into 20 pounds of water containing 0.25 pounds of urea, 0.30 pounds diammonium phosphate, and 0.6 pounds inverted sugar. The tobacco-water mix was then loaded into a steam vessel wherein 100 psi saturated steam was introduced bringing the temperature within the vessel to 335° F. The 335° temperature was held for three minutes. After the three minutes the pressure vessel was depressurized to ambient in less than 1 minute and simultaneously transferred to a cyclone separator where steam was exhausted and the tobacco product was recovered.

A 1.10 pound sample of the steam pressurized tobacco was added to a vessel containing 9.91 pounds water. This mixture was then heated to 170° F. and held at this temperature for 30 minutes to allow the water to extract soluble components from the steam pressurized tobacco. This mixture was then centrifuged in a Bock centrifugal extractor for 2 minutes at 12,000 rpm. A 300 gram sample of extracted residue was mixed with 700 ml of water, refined and formed into paper like sheets on a Fourdiner type wire papermaking machine. The extract was submitted to a Buchi Rotavapor 150 vacuum evaporator wherein the extract was vaporized to about 35 percent solids. This extract containing 35 percent solids was then applied back to the previously made reconstituted tobacco sheet by coating the sheets coming off the wire papermaking machine. The sheet material was then incorporated into cigarettes.

EXAMPLE 2

A reconstituted tobacco sheet was made in the same manner in Example 2 as that in Example 1, except that the steam pressure vessel was subjected to 67 psi saturated steam thereby raising the temperature to 300° F. The pressure vessel was maintained at the 67 psi steam and 300° F. for 6 minutes. The resulting reconstituted sheet material was then incorporated into cigarettes.

EXAMPLE 3

This example was carried out in the same manner and with the same quantities of materials as that utilized in Example 1, the only change being that the tobacco was subjected to a steam pressure of 420 psi and 400° F. and held at this pressure and temperature for 5 minutes. The resulting reconstituted sheet tobacco was incorporated into cigarettes.

EXAMPLE 4

This example was carried out in the same manner and with the same quantities of materials as that utilized in Example 1, except that tobacco was steam treated at 67 psi and 300° F. for 10 minutes.

EXAMPLE 5

This example was carried out in the same manner and with the same quantities of materials as that utilized in Example 1, except that tobacco was steam treated at 100 psi and 335° F. for 3 minutes. Tobacco was also held in contact with the additives for 5–6 hours before steam treatment.

EXAMPLE 6

A total of 10 pounds of tobacco materials in the form of 0.6 pounds flue cured scraps, 0.9 pounds of burley scraps, 1.2 pounds threshing and fabrication dusts, 0.3 pounds shredded tobacco meal, 3.1 pounds small flue cured stems, 3.0 pounds small burley stems and 0.9 pounds large burley stems were dispersed in 20 pounds of water. The tobacco-water mix was loaded into a steam pressure vessel and treated with 100 psi saturated steam raising the temperature to 335° F. and held in this condition for 3 minutes.

Subsequently, 1.10 pounds of the steam treated tobacco was added to 9.91 pounds of water containing 0.018 pounds urea and 0.03 pounds of diammonium phosphate. The mixture was heated to 170° F. and held at this temperature for 30 minutes to extract the water soluble components of the steam treated tobacco. The mixture was then centrifuged in a Bock centrifugal extractor for 12 minutes at 12,000 rpm. A total of 300 grams of the extracted residue was mixed with 700 ml water, refined and formed into paper like sheet in a Fourdiner type with papermaking machine. The extract was concentrated by vacuum evaporation in a Buchi Rotavapor 150 at 140° F. to about 35 percent solids and invert sugar was added to form 3.3% by weight of the finished product. The concentrated extract was applied to the sheet with a size press. The resulting reconstituted sheet tobacco was incorporated into cigarettes.

EXAMPLE 7

A total of 10 pounds of tobacco materials in the form of 0.6 pounds flue cured scraps, 0.9 pounds of burley scraps, 1.2 pounds threshing and fabrication dusts, 0.3 pounds shredded tobacco meal, 3.1 pounds small flue cured stems, 3.0 pounds small burley stems and 0.9 pounds large burley stems were dispersed in 20 pounds of water. The tobacco-water mix was loaded into a steam pressure vessel and treated with 67 psi saturated steam raising the temperature to 300° F. and held in this condition for 5 minutes.

Subsequently, 1.10 pounds of the steam exploded tobacco was added to 9.91 pounds of water containing 0.018 pounds urea and 0.03 pounds of diammonium phosphate. The mixture was heated to 170° F. and held at this temperature for 30 minutes to extract the water soluble components of the steam exploded tobacco. The mixture was then centrifuged in a Bock centrifugal extractor for 12 minutes at 12,000 rpm. A total of 300 grams of the extracted residue was mixed with 700 ml water, refined and formed into paper like sheet. The extract was concentrated by vacuum evaporation in a Buchi Rotavapor 150 at 140° F. to about 35 percent solids and invert sugar was added to form 3.3% by weight of the finished product. The concentrated extract was applied to the sheet with a size press and the resulting reconstituted tobacco sheet was incorporated into cigarettes.

EXAMPLE 8

A total of 10 pounds of tobacco materials in the form of 0.6 pounds flue cured scraps, 0.9 pounds of burley scraps, 1.2 pounds threshing and fabrication dusts, 0.3 pounds shredded tobacco meal, 3.1 pounds small flue cured stems, 3.0 pounds small burley stems and 0.9 pounds large burley stems were dispersed in 20 pounds of water. The tobacco-water mix was loaded into a steam vessel and treated with 422 psi saturated steam raising the temperature to 400° F. and held in this condition for 5 minutes.

Subsequently, 1.10 pounds of the steam exploded tobacco was added to 9.91 pounds of water containing 0.018 pounds urea and 0.03 pounds of diammonium phosphate. The mixture was heated to 170° F. and held at this temperature for 30 minutes to extract the water soluble components of the steam exploded tobacco. The mixture was then centrifuged in a Bock centrifugal extractor for 12 minutes at 12,000 rpm. A total of 300 grams of the extracted residue was mixed with 700 ml water, refined and formed into paper like sheet. The extract was concentrated by vacuum evaporation in a Buchi Rotavapor 150 at 140° F. to about 35 percent solids and invert sugar was added to form 3.3% by weight of the finished product. The concentrated extract was applied to the sheet with a size press and the resulting reconstituted sheet was incorporated into cigarettes.

EXAMPLE 9

A total of 10 pounds of tobacco materials in the form of 0.6 pounds flue cured scraps, 0.9 pounds of burley scraps, 1.2 pounds threshing and fabrication dusts, 0.3 pounds shredded tobacco meal, 3.1 pounds small flue cured stems, 3.0 pounds small burley stems and 0.9 pounds large burley stems were dispersed in 20 pounds of water. The tobacco-water mix was loaded into a steam pressure vessel and treated with 67 psi saturated steam raising the temperature to 300° F. and held in this condition for 10 minutes.

Subsequently, 1.10 pounds of the steam exploded tobacco was added to 9.91 pounds of water containing 0.018 pounds urea and 0.03 pounds of diammonium phosphate. The mixture was heated to 170° F. and held at this temperature for 30 minutes to extract the water soluble components of the steam exploded tobacco. The mixture was then centrifuged in a Bock centrifugal extractor for 12 minutes at 12,000 rpm. A total of 300 grams of the extracted residue was mixed with 700 ml water, refined and formed into paper like sheet in a standard TAPPI box for ordinary papermaking techniques. The extract was concentrated by vacuum evaporation in a Buchi Rotavapor 150 at 140° F. to about 35 percent solids and invert sugar was added to form 3.3% by weight of the finished product. The concentrated extract was applied to the sheet with a size press.

Cigarettes prepared with reconstituted tobacco from Examples 6–9 were found to have a mild and pleasant taste but those made with reconstituted tobacco from Examples 1–5, which were prepared by adding the urea and ammonium salt prior to steam pressurization were found to have a milder and more pleasant taste, than those cigarettes using Examples 6–9 reconstituted tobacco.

The foregoing detailed description and Examples are given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A method for making a tobacco slurry for use in manufacturing reconstituted tobacco sheets comprising the steps of:

a) adding from 50 to 100 parts by weight of tobacco materials to a vessel containing from 100 to 200 parts by weight of water, and from about 2 to 40 parts by weight of chemical additives including from about 1 to 10 parts by weight of an ammonium salt and from about 1 to 10 parts by weight of urea, said resulting mixture being a first tobacco slurry;

b) bringing the first tobacco slurry to a temperature of from about 200 to 420° F. with 60 to 400 psi of saturated steam and holding said temperature and pressure for a period of from about 1 to 5 minutes; and, c) reducing the pressure on the first tobacco slurry to ambient in from 0.1 to 1.0 minutes.

2. The method of claim 1 wherein said ammonium salt is selected from the group consisting of, ammonium acetate, ammonium chloride, ammonium phosphate, and mixtures thereof.

3. The method of claim 1, including the addition of up to 1 part by weight of a humectant.

4. The method of claim 3 wherein said humectant is selected from the group consisting of glycerine and propylene glycol.

5. The method of claim 1 including the addition of other chemical additives selected from the group consisting of citric acid, lactic acid, inverted sugars and mixtures thereof.

6. The method of claim 5, the inverted sugars including glucose and fructose.

7. The method of claim 5, said inverted sugars being up to 1 part by weight.

8. The method of claim 6, said inverted sugars being added with said urea and ammonium salt.

9. The method of claim 6, said inverted sugar being added after step c) of claim 1.

10. The method of claim 1, said ammonium salt being from 1 to 5 parts by weight.

11. The method of claim 1, said urea being from 1 to 5 parts by weight.

12. A method of making a sheet of reconstituted tobacco comprising the steps of:

a) adding from 50 to 100 parts by weight of tobacco materials to a vessel containing from 100 to 200 parts by weight of water, and from about 2 to 40 parts by weight of chemical additives including from about 1 to 10 parts by weight of an ammonium salt and from about 1 to 10 parts by weight of urea, said resulting mixture being a first tobacco slurry;

b) bringing the first tobacco slurry to a temperature of from about 200 to 420° F. with 60 to 400 psi of saturated steam and holding said temperature and pressure for a period of from about 1 to 5 minutes;

c) reducing the pressure on the first tobacco slurry to ambient in from 0.1 to 1.0 minutes;

d) adding water to said first tobacco slurry to form a second tobacco slurry having from 15 to 40 percent by weight tobacco;

e) heating said second tobacco slurry to from 120 to 180° F. for about 2 to 5 minutes;

f) removing water and solubles from the second tobacco slurry to form a third tobacco slurry containing from about 50 to 60 percent by weight of water and a first extract;

g) reducing the particle size of the tobacco materials in said third tobacco slurry;

h) adding water to said third tobacco slurry to form a fourth tobacco slurry having from about 1 to 4 percent by weight tobacco; and i) forming a sheet of tobacco using the fourth slurry having from about 10 to 30 percent by weight moisture.

13. The method of claim 11 wherein said ammonium salt is selected from the group consisting of, ammonium acetate, ammonium chloride, ammonium phosphate, and mixtures thereof.

14. The method of claim 12, including the addition of up to 1 part by weight of a humectant.

15. The method of claim 14 wherein said humectant is selected from the group consisting of glycerine and propylene glycol.

16. The method of claim 12 including the addition of other chemical additives selected from the group consisting of citric acid, lactic acid, inverted sugars and mixtures thereof.

17. The method of claim 16, the inverted sugars including glucose and fructose.

18. The method of claim 16, said inverted sugars being up to 1 part by weight.

19. The method of claim 12, said step f) including a centrifuge to remove said water including solubles to form said first extract and said third tobacco slurry.

20. The method of claim 12 including reducing the particle size in step g) in a vessel having agitation means therein.

21. The method of claim 12, said step i) including a papermaking machine.

22. The method of claim 21, said papermaking machine including a Fourdiner wire for draining water therethrough.

23. The method of claim 12 including the following additional steps of:

j) concentrating said first extract to a solution containing from 30 to 35 percent by weight solubles; and, k) coating said sheet of tobacco formed in step i).

24. The method of claim 12, said chemical additives being from 10 to 25 parts by weight.

25. The method of claim 12, said ammonium salt being from 5 to 10 parts by weight.

26. The method of claim 12, said urea being from 3 to 8 parts by weight.

27. The method of claim 12, said sheet of tobacco having about 13 to 16 percent by weight moisture.

* * * * *